US011910924B2

(12) United States Patent
Storck et al.

(10) Patent No.: US 11,910,924 B2
(45) Date of Patent: Feb. 27, 2024

(54) CABINET DRAWER WITH A RACK CONFIGURED TO CARRY OUT A TRANSLATORY MOVEMENT INTO A PULL-OUT POSITION AND A PIVOTING MOVEMENT IN THE PULL-OUT POSITION

(71) Applicant: Kesseböhmer Holding KG, Bad Essen (DE)

(72) Inventors: Holger Storck, Damme (DE); Hermann Buschermöhle, Bersenbrück (DE)

(73) Assignee: Kesseböhmer Holding KG, Bad Essen (DE)

( * ) Notice: Subject to any disclaimer, the term of this patent is extended or adjusted under 35 U.S.C. 154(b) by 142 days.

(21) Appl. No.: 17/765,205

(22) PCT Filed: Sep. 22, 2020

(86) PCT No.: PCT/EP2020/076417

§ 371 (c)(1),
(2) Date: Mar. 30, 2022

(87) PCT Pub. No.: WO2021/063749

PCT Pub. Date: Apr. 8, 2021

(65) Prior Publication Data

US 2022/0378202 A1 Dec. 1, 2022

(30) Foreign Application Priority Data

Sep. 30, 2019 (DE) ..... 10 2019 126 353.0

(51) Int. Cl.
*A47B 88/42* (2017.01)
*A47B 61/02* (2006.01)
*A47B 88/48* (2017.01)

(52) U.S. Cl.
CPC ..... *A47B 88/42* (2017.01); *A47B 61/02* (2013.01); *A47B 88/48* (2017.01); *A47B 2210/0081* (2013.01)

(58) Field of Classification Search
CPC ..... A47B 88/42; A47B 88/48; A47B 51/00; A47B 53/00; A47B 49/00; A47B 61/02;
(Continued)

(56) References Cited

U.S. PATENT DOCUMENTS 1,010,950 A * 12/1911 Prather ..... A47B 88/48 312/123
6,199,966 B1 * 3/2001 Fulterer ..... A47B 88/42 312/270.3

(Continued)

FOREIGN PATENT DOCUMENTS

AT 503010 B1 * 7/2007 ..... A47B 88/42
DE 202004021512 U1 * 10/2008 ..... A47B 88/0485

(Continued)

*Primary Examiner* — Jennifer E. Novosad
(74) *Attorney, Agent, or Firm* — Gudrun E. Huckett

(57) ABSTRACT

The invention relates to a cabinet drawer (1), in particular for tall cabinets, comprising a frame (4) which is to be arranged in the interior of the cabinet body (2) and has a cabinet door (3) or a similar cabinet covering on the front face on a vertical longitudinal support (6). The frame (4), which has a respective support base (7), can be moved out of a first operating position, which lies within the cabinet body (2), into a pull-out position, which lies in front of the cabinet body (2), as a second operating position in a translational manner, and the frame (4), which has an upper (8) and a lower (9) pull-out rail, can be converted into the second operating position using a rear vertical longitudinal support (5) such that the frame (4) can be pivoted about a vertical pivot axis in the second operating position. The cabinet drawer (1) is paired with a blocking device (13) which prevents the frame (4) from carrying out a pivoting movement before reaching the second operating position and releases the frame (4) to carry out a pivoting movement in the second operating position. The aim of the invention is to improve such a cabinet drawer (1). This is achieved in that the blocking device (13) has a slotted gate part (14) which can be pivoted about a vertical axis and comprises a guide path (15), the slotted gate part (14) together with the frame (4) can be moved into the second operating position, a guide part (16) of the frame (4) is guided in the guide path (15) of
(Continued)

the slotted gate part (14) during a part of the pivoting movement of the frame, and the slotted gate part (14) is arranged within the blocking device (13) in the course of the translational movement of the frame (4) into the second operating position so as to be prevented from carrying out a pivoting movement.

10 Claims, 9 Drawing Sheets

(58) Field of Classification Search
CPC ..... A47B 49/004; A47B 49/006; A47B 2210/0081; A47B 2088/421; A47B 88/433; A47B 2200/0011; A47B 2210/0056; A47B 2210/0062
USPC ..... 211/162; 312/326, 334.47, 322, 224.24
See application file for complete search history.

(56) References Cited

U.S. PATENT DOCUMENTS

| | | | | |
|---|---|---|---|---|
| 6,398,323 | B1 * | 6/2002 | Lee | A47B 61/02 312/321 |
| 7,832,816 | B2 * | 11/2010 | Compagnucci | A47B 88/42 312/322 |
| 8,083,303 | B2 * | 12/2011 | Compagnucci | A47B 81/002 312/238 |
| 9,756,938 | B2 * | 9/2017 | Ueda | A47B 49/002 |
| 10,251,480 | B2 * | 4/2019 | Chen | A47B 88/407 |
| 11,083,312 | B2 * | 8/2021 | Bersagel | A47F 5/0087 |
| 11,448,457 | B2 * | 9/2022 | Scalf | F25D 23/028 |
| 2004/0201340 | A1 * | 10/2004 | Chen | A47B 88/493 312/334.46 |
| 2004/0232810 | A1 * | 11/2004 | Kreyenkamp | A47B 88/48 312/322 |
| 2008/0197758 | A1 * | 8/2008 | Mushan | A47B 88/493 312/334.1 |
| 2009/0051256 | A1 * | 2/2009 | Compagnucci | A47B 81/002 312/322 |
| 2017/0238709 | A1 * | 8/2017 | Chen | A47B 88/483 |
| 2019/0167000 | A1 * | 6/2019 | Storck | A47B 88/48 |
| 2020/0154884 | A1 * | 5/2020 | Huang | A47B 88/42 |
| 2022/0378202 | A1 * | 12/2022 | Storck | A47B 88/42 |

FOREIGN PATENT DOCUMENTS

| | | | | |
|---|---|---|---|---|
| DE | 20 2018 103 969 | | 9/2018 | |
| EP | 1 479 318 | | 11/2004 | |
| EP | 1 820 422 | | 8/2007 | |
| EP | 1972229 | A1 * | 9/2008 | A47B 88/42 |
| EP | 2430948 | A1 * | 3/2012 | A47B 88/0485 |
| EP | 2250935 | B1 * | 5/2014 | A47B 88/0485 |
| WO | 2007/000785 | | 1/2007 | |
| WO | WO-2021063749 | A1 * | 4/2021 | A47B 88/42 |

* cited by examiner

CABINET DRAWER WITH A RACK CONFIGURED TO CARRY OUT A TRANSLATORY MOVEMENT INTO A PULL-OUT POSITION AND A PIVOTING MOVEMENT IN THE PULL-OUT POSITION

BACKGROUND OF THE INVENTION

The invention relates to a pull-out cabinet unit, in particular for tall pull-out cabinets, having a rack which is to be arranged in an interior space of a basic cabinet structure and, on its front side, carries a cabinet door or similar cabinet cover on a longitudinal support, wherein the rack, which carries respective shelves, can be moved in translatory fashion from a first operating position, located within the basic cabinet structure, into a second operating position, located in front of the basic cabinet structure, and wherein the rack, which has an upper pull-out rail and a lower pull-out rail, can be transferred, by way of a rear vertical longitudinal support, into the second operating position such that, in this second operating position, the pull-out cabinet unit can be pivoted about a vertical pivot axis.

The pull-out cabinet unit here is assigned a blocking device which, prior to the second operating position being reached, prevents the rack from pivoting and, in the second operating position, releases the pull-out cabinet unit for pivoting.

In the case of generally known tall cabinets which are referred to as a pull-out larder, a carrier part which is guided into a center longitudinal plane of the basic cabinet structure by way of pull-out rails or the like is designed in the form of a largely closed rack, respective shelves being retained between the vertical longitudinal supports of the rack in such a way as to ensure that the shelves can be accessed from two sides in the second operating position, forming a fully pulled-out position. In order for items to be removed from oppositely located regions of the shelves, it is additionally necessary for the user to walk around the pull-out cabinet unit located in the second operating position, so that, in particular when the shelves are fully loaded, problem-free removal of items is only possible in a relatively time-consuming manner. An example of such a cabinet having a corresponding pull-out apparatus is known from EP 1 479 318 B1.

It is also the case that such a pull-out cabinet unit mentioned in the introduction is known from EP 1 820 422, in the case of which a blocking device is provided in addition, the blocking device having a blocking lever, which can be pivoted about a horizontal axis and locks the first pull-out rail, as seen in the pull-out direction, and the second pull-out rail, as seen in the pull-out direction, on one another such that, during the translatory pull-out movement, the rack is reliably retained in its position parallel to the pull-out rails, for blockage-free translatory pull-out movement. However, for the purpose of unlocking the blocking lever of the blocking device, complex components are required, in order to allow the rack to be released for pivoting. In addition, increased operational outlay is necessary for this purpose.

WO 2007/000785 A1 likewise discloses a pull-out cabinet unit which is intended for tall cabinets and, similarly to the aforementioned document EP 1 479 318 B1, comprises a largely closed rack which has a front vertical longitudinal support and a rear vertical longitudinal support and, via upper pull-out rails and lower pull-out rails, which interengage telescopically, can be moved into a position located within the tall cabinet and into a position in which the rack has been pulled all the way out of the cabinet, so that a user has to walk around the pull-out rack in order to remove items from oppositely located regions of the shelves. It is therefore also the case with this pull-out rack that problem-free removal of stored items is possible only in a relatively time-consuming manner.

The object of the present invention is to develop a pull-out cabinet unit of the type mentioned in the introduction such that, in its second operating position, the rack can be reliably pivoted into an operating position, only relatively low, cost-effective outlay in terms of components being necessary for this purpose.

SUMMARY OF THE INVENTION

In order to achieve this object, the pull-out apparatus for pull-out cabinet units of the type mentioned in the introduction is distinguished in that the blocking device has a guide-track part, which can be pivoted about a vertical axis and has a guide path, and in that the guide-track part can be displaced into the second operating position with the rack, wherein a guide part of the rack is guided in the guide path of the guide-track part during some of the pivoting movement, and wherein, during the course of the translatory movement of the rack into the second operating position, the guide-track part is arranged within the blocking device so as to be prevented from pivoting.

This creates a pull-out cabinet unit in which the rack of the pull-out cabinet unit, together with the shelves and items stored thereon, can be reliably moved out of the interior of a basic cabinet structure until it is located just in front of the second operating position (fully pulled-out position). Further movement of the first pull-out rail, as seen in the pull-out direction, along with the rack supported thereon relative to the following pull-out rail, as seen in the pull-out direction, automatically makes it possible for the blocking device to release the guide-track part and thus the rack, so that the latter can be pivoted about a vertical axis.

A pin-formed guide part preferably engages in the guide path of the guide-track part here, so that the pivoting movement is forcibly controlled as a result. Following a first section of the pivoting movement into the full operating position, oriented orthogonally in relation to the pull-out rails, the guide part can leave the guide path, and, following a pivoting-back movement, it is automatically moved into this guide path again until it has reached the position parallel to the pull-out rails. It is possible to provide, for this purpose, a specific securing part with corresponding recesses and elevations, so that the securing part can be latched in in this position, whereby the rack and the pull-out rails is reliably transferred back again into the first operating position, in which the rack is located within the basic cabinet structure.

The telescopic pull-out unit is preferably designed in the form of a constituent part of the pull-out cabinet unit with three pull-out rails of cost-effective construction, to be precise in the lower region and in the upper region of the cabinet, wherein the guide-track part together with the guide rail can be provided both at the bottom or at the top, in the region of an upper pull-out rail or lower pull-out rail of the pull-out cabinet unit. It is likewise possible for the blocking device to be part of the first pull-out rail, but also, as illustrated in the preferred exemplary embodiment, part of a second pull-out rail, that is to say a central pull-out rail, which is located between the first pull-out rail, as seen in the pull-out direction, and the third pull-out rail, as seen in the pull-out direction, this third pull-out rail being fastened at a fixed location on the basic cabinet structure.

BRIEF DESCRIPTION OF THE DRAWINGS

For a further explanation of the invention, reference is made to further dependent claims, to the following description and to the drawing, in which:

Figure 1:
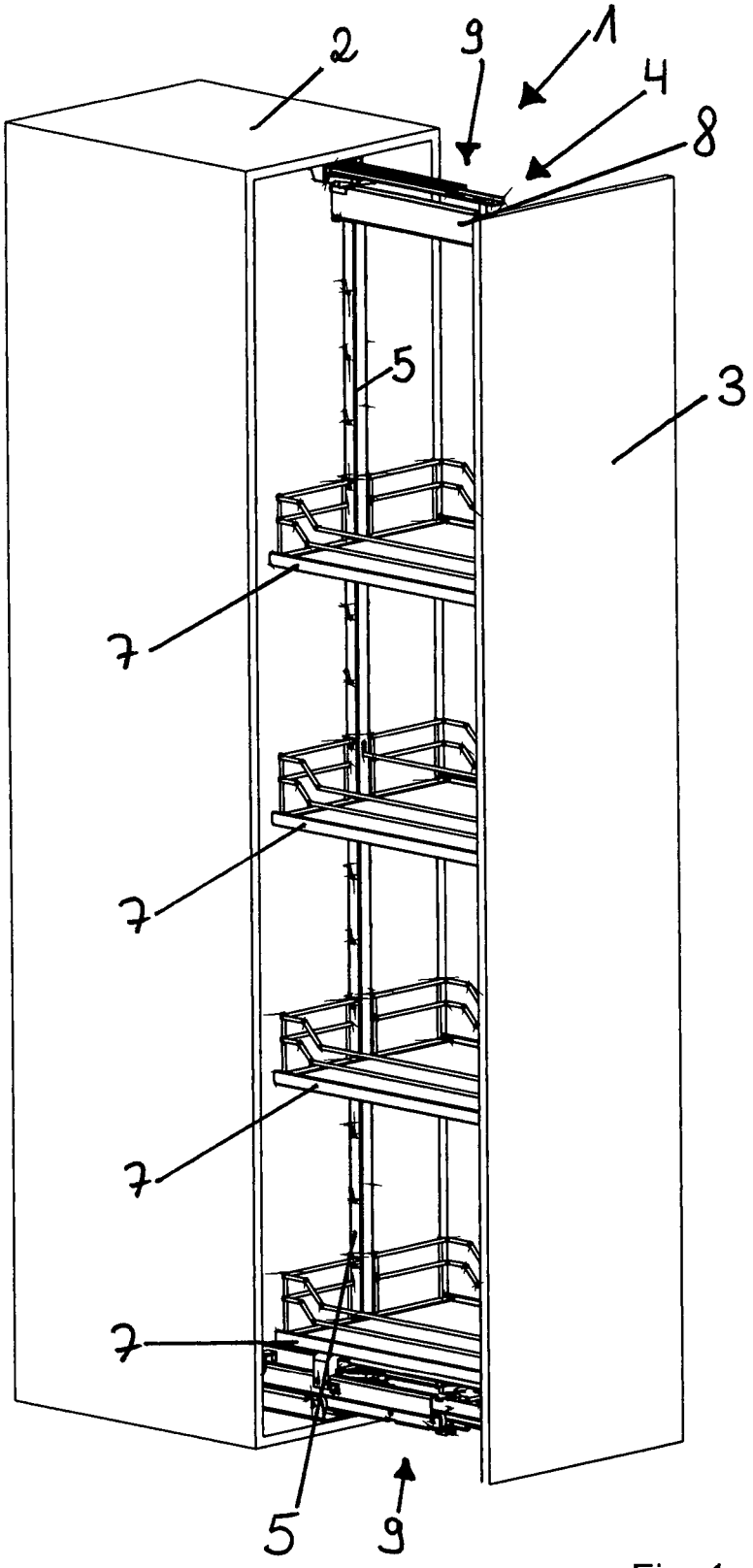
FIG. 1 shows an exemplary embodiment of a pull-out apparatus which is mounted in a tall cabinet (pull-out larder) and is in the partially pull-out state.

In the drawings, parts which basically correspond are provided with corresponding reference signs.

DESCRIPTION OF PREFERRED EMBODIMENTS

Figure 2:
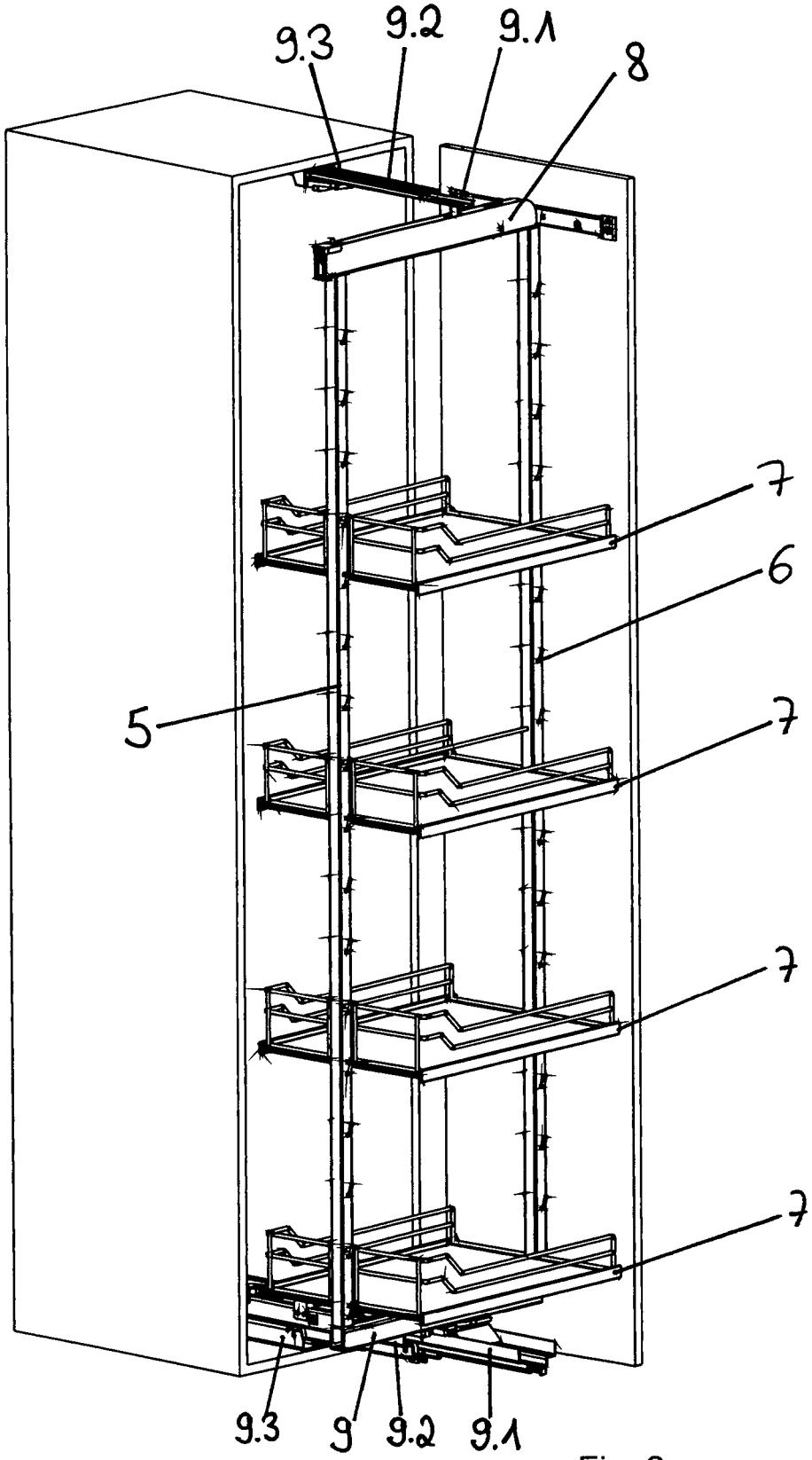
FIGS. 2 and 3 show the exemplary embodiment according to FIG. 1 in the respectively pivoted state of the rack.
Figure 3:
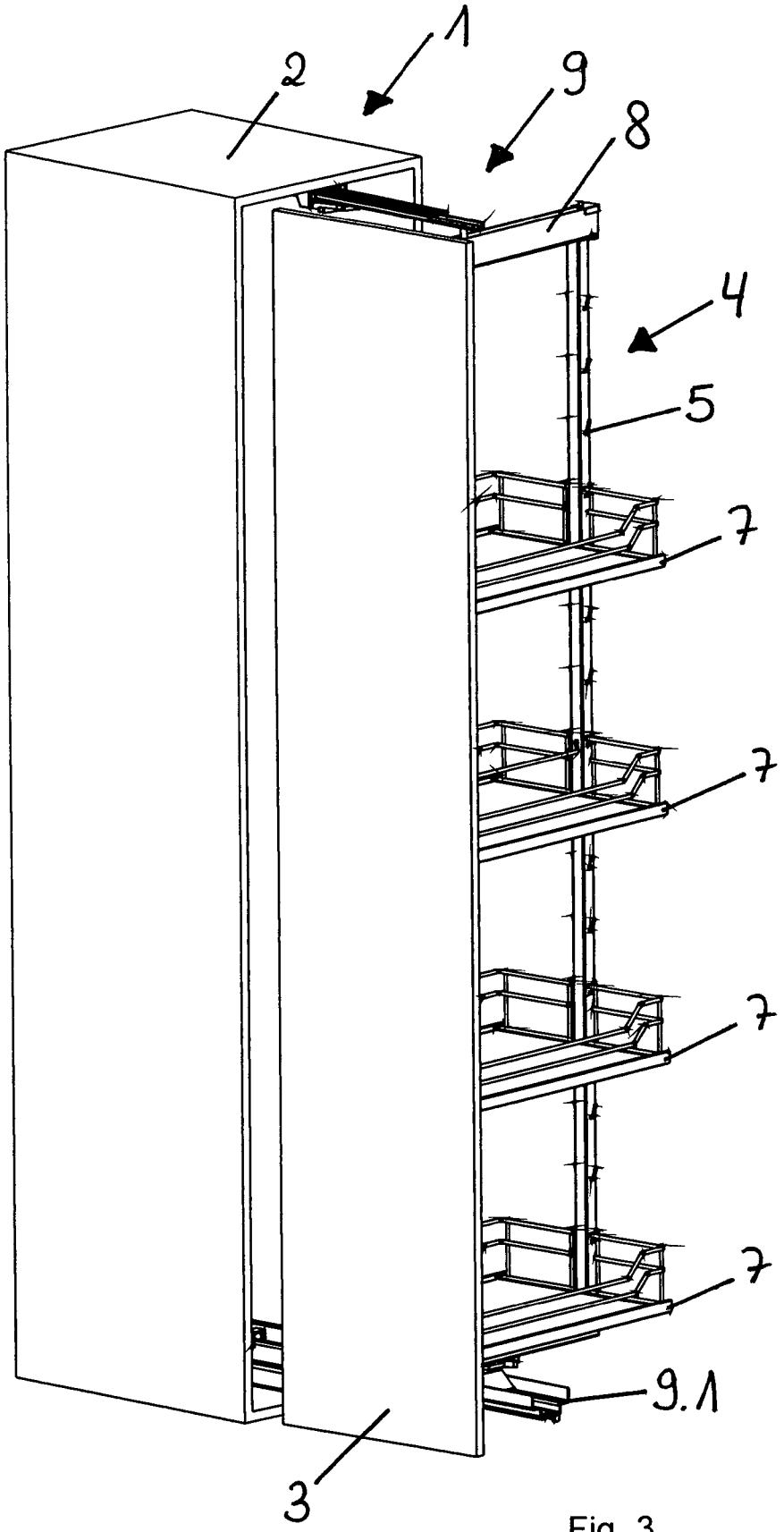
Figure 4:
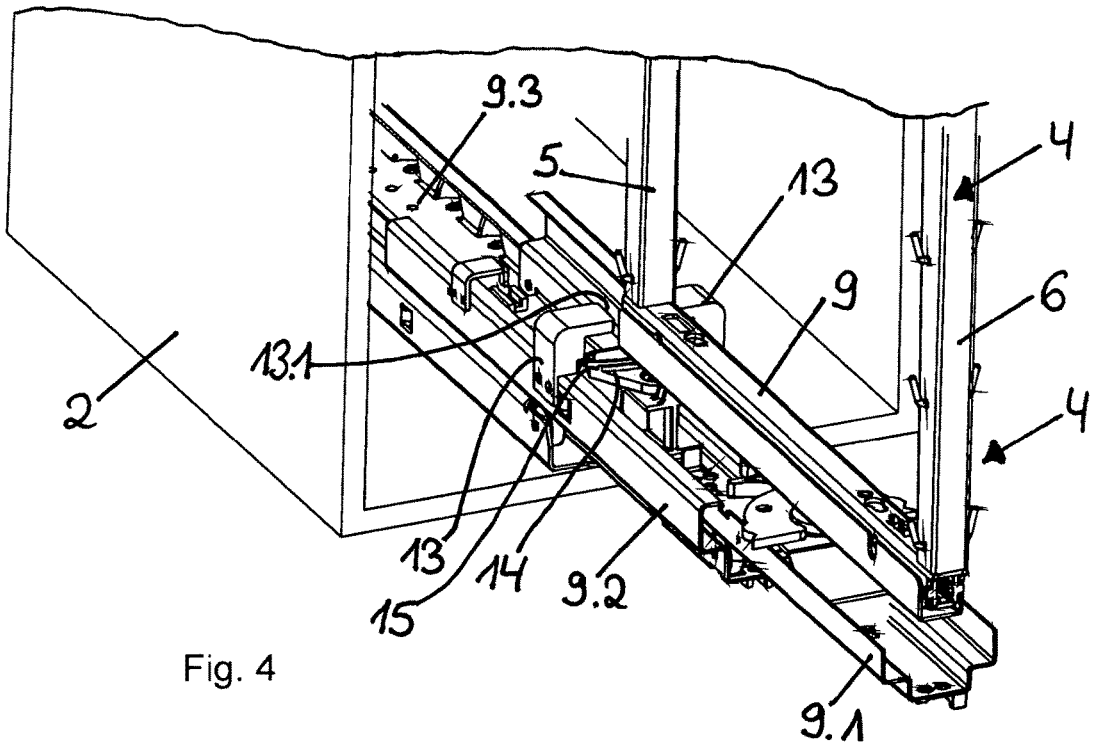
FIG. 4 shows, in detail form, a perspective illustration of the pull-out apparatus with the rack just prior to the second operating position being reached.

1 is used, in general, to denote a tall cabinet which has a basic furniture structure 2 and a cabinet cover 3, this tall cabinet therefore being designed in the manner of a pull-out larder. The cabinet cover 3 is retained by a rack which is denoted, in general, by 4 and has two vertical longitudinal supports 5 and 6, wherein the cabinet cover 3 is retained by the vertical longitudinal support 6 (FIG. 2). Shelves 7 are retained between the vertical longitudinal supports 5 and 6.

The rack 4 has an upper pull-out rail 8 and a lower pull-out rail 9, which together with the vertical longitudinal supports 5, 6 form a rectangular-frame-like rack 4.

A telescopic pull-out unit having in total three pull-out rails 9.1, 9.2 and 9.3 is provided for the purpose of pulling out the rack 4, wherein the first pull-out rail 9.1, as seen in the pull-out direction, can be moved relative to the second (central) pull-out rail 9.2, as seen in the pull-out direction, which, for its part, can be moved relative to the third pull-out rail 9.3, as seen in the pull-out direction, the third pull-out rail being mounted at a fixed location in the basic cabinet structure 2. The pull-out rails 9.1, 9.2 and 9.3 can be provided both for the lower pull-out rail 9 of the rack 4 and for the upper pull-out rail 8 of the rack 4.

Figure 9:
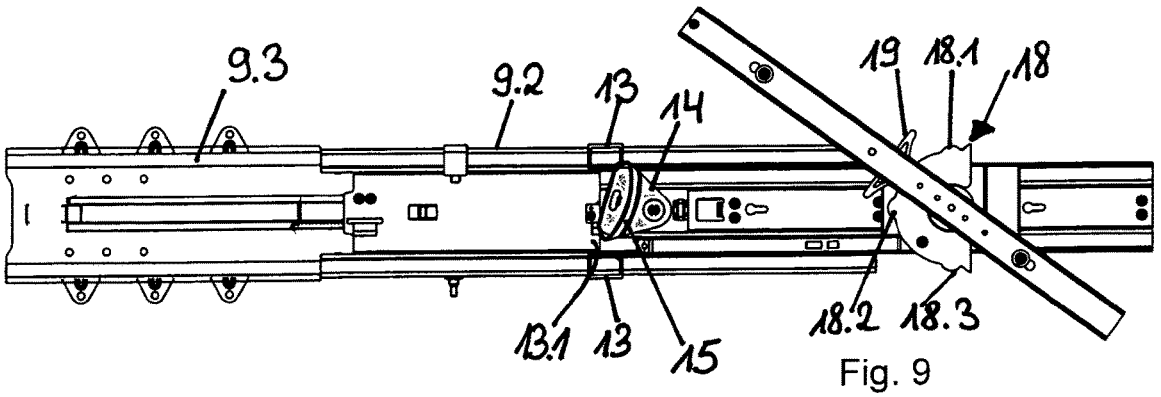
Figure 10:
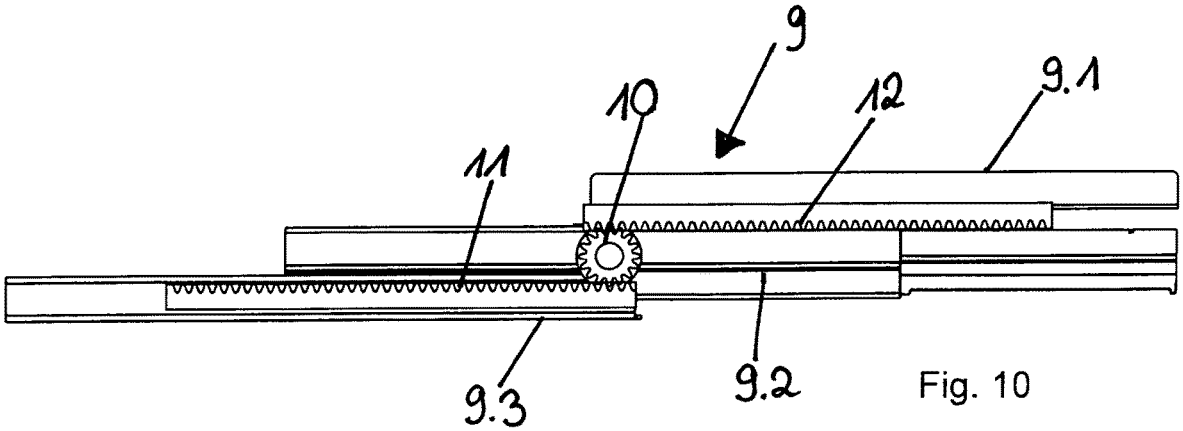
FIG. 10 shows a view of the pull-out rails from the side and with the forcible synchronization of the pull-out rails.
Figure 11:
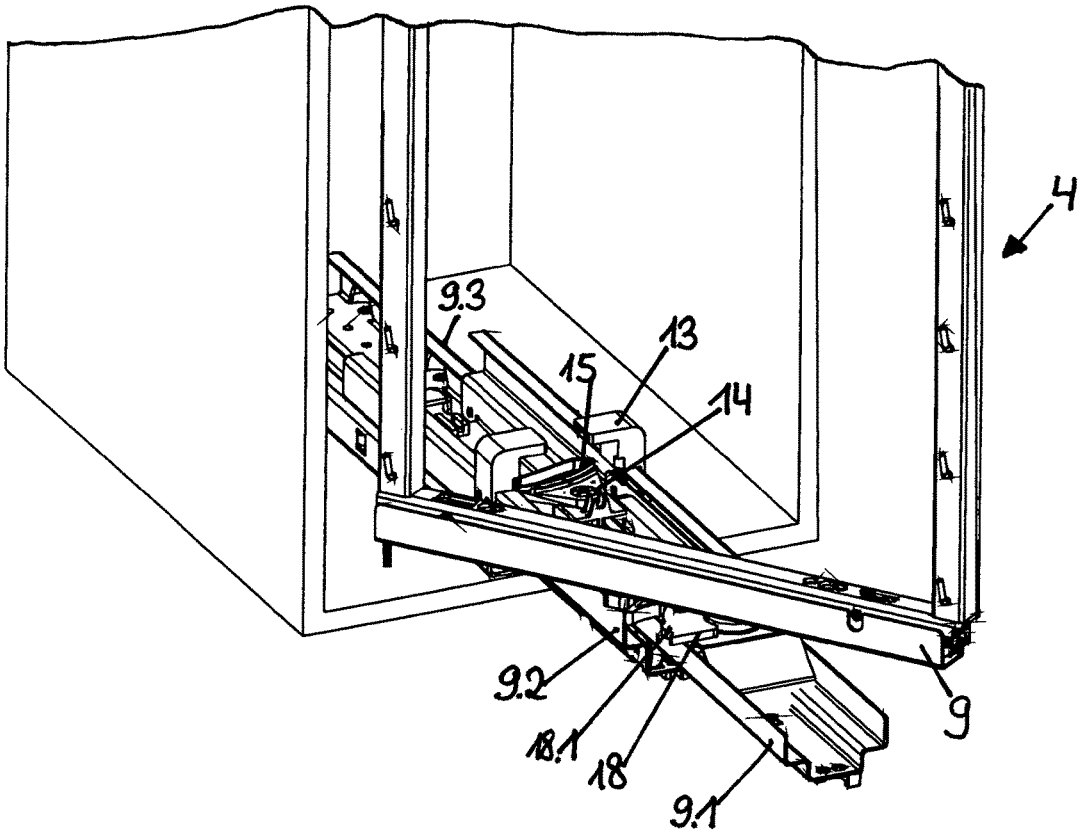
FIG. 11 shows an illustration similar to FIG. 7.
Figure 12:
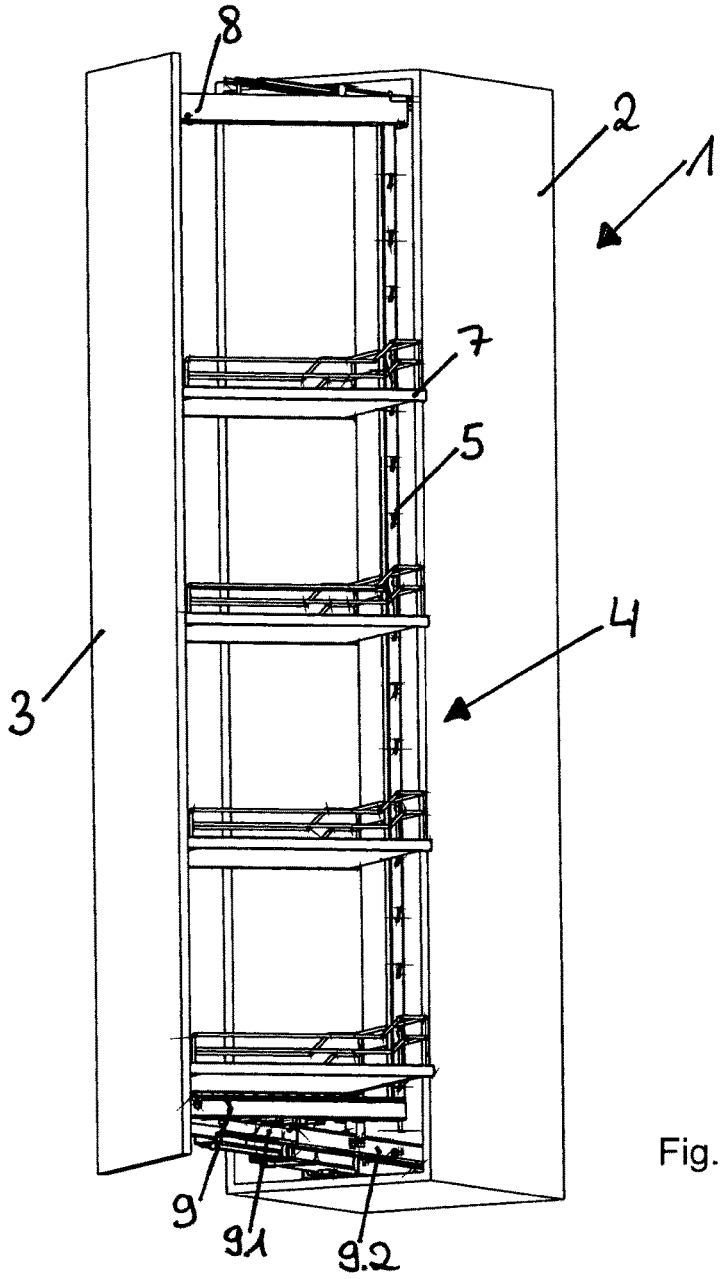
FIG. 12 shows a perspective view of the exemplary embodiment according to FIG. 1 in the partially pivoted state.
Figure 13:
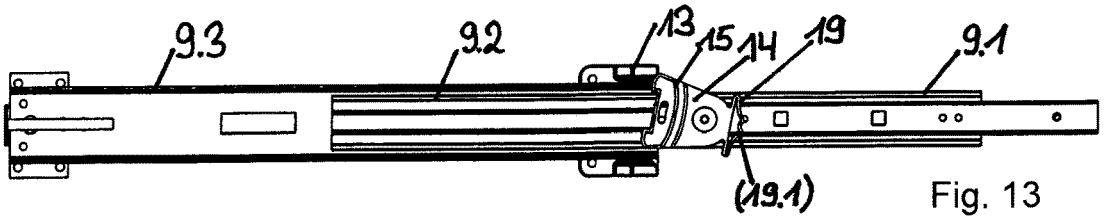
FIGS. 13 and 14 show a plan view of the pull-out rails, firstly in the state in which pivoting can be initiated (FIG. 13) and secondly in the state in which pivoting cannot yet be carried out (FIG. 14)
Figure 14:
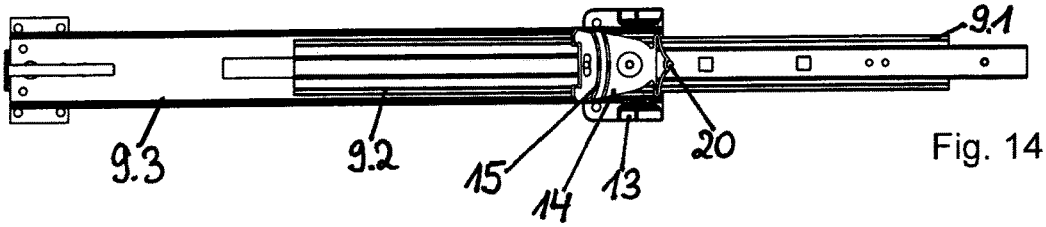
Figure 15:
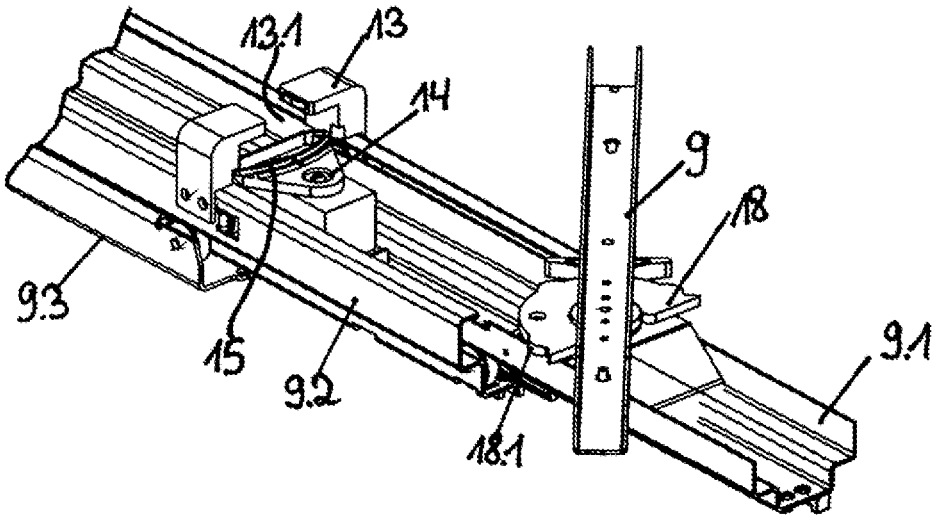
FIG. 15 shows, in detail form, a perspective illustration of the pull-out rails with the rack in the pivoted state.

The lower pull-out rails 9.1, 9.2 and 9.3 are forcibly synchronized by a gearwheel 10 and also toothing formations 11 and 12, as are depicted in FIG. 10. As FIGS. 4, 5, 6, 7, 8, 9, 11, 12, 13, 14, 15, 16, 17 and 18 depict in more detail, the rack 4 is supported on the first pull-out rail 9.1 such that it can be pivoted about a vertical axis. A blocking device 13 is provided on the second pull-out rail 9.2, the blocking device comprising two angled limbs which are directed toward one another and act on the second pull-out rail 9.2. In the region of the mutually facing ends, these two angled limbs have an interspace or through-space 13.1, wherein the mutually facing ends of the two limbs of the blocking device 13, which bound the through-space 13.1, form stops for a guide-track part 14, in which is made a guide path 15 for a guide part 16, which is provided on the lower pull-out rail 9 of the rack 4 (FIG. 7).

Figure 5:
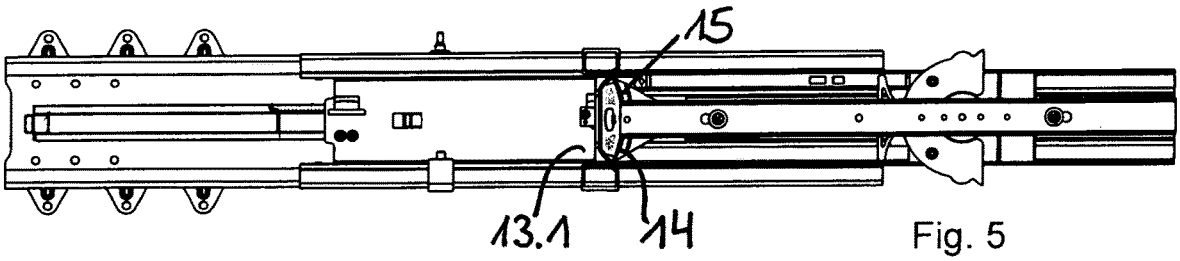
FIG. 5 shows a plan view of the pull-out rails of the exemplary embodiment according to FIG. 4 with the rack just prior to the second operating position being reached, but in the as yet non-pivoted state.
Figure 6:
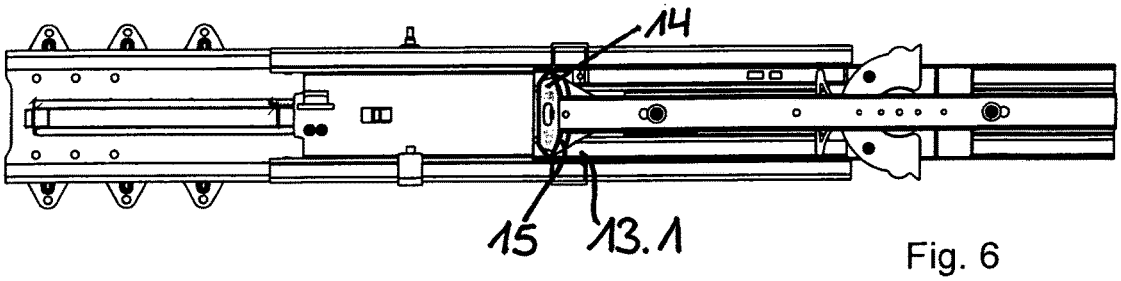
FIG. 6 shows an illustration which is analogous to FIG. 5, which shows the rack in a state in which it has not yet been pulled all the way out, and in the case of which the guide-track part is still located within the blocking device.
Figure 7:
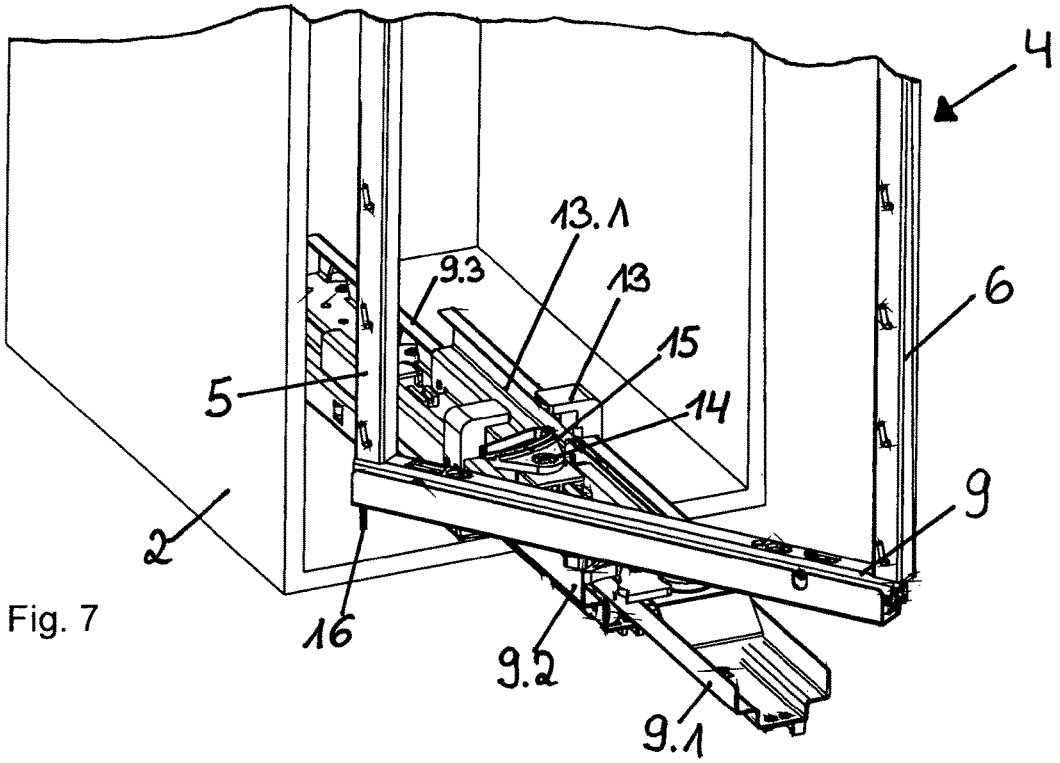
FIG. 7 shows an illustration which is analogous to FIG. 4 and in the case of which the rack is partially pivoted.
Figure 8:
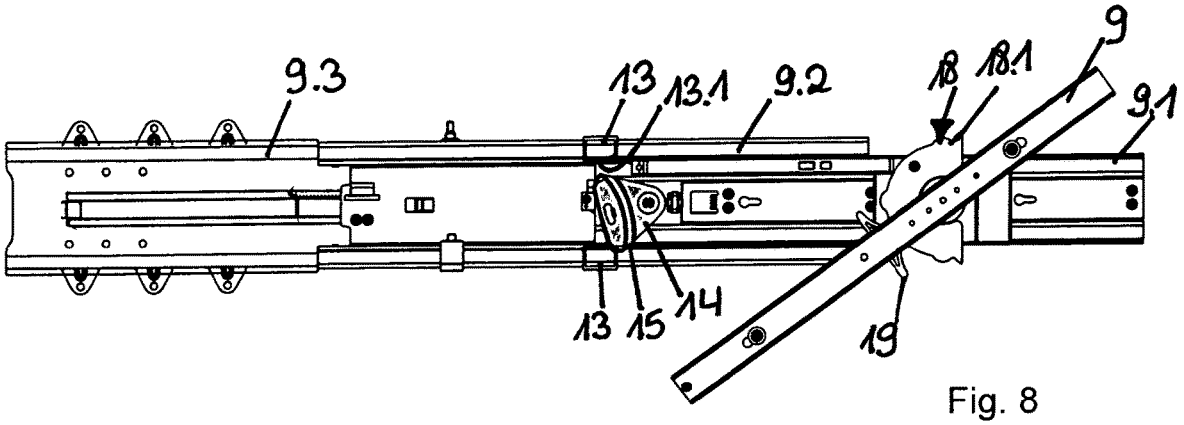
FIGS. 8 and 9 show a plan view of the pull-out rail and the rack in the state according to FIG. 7, firstly pivoted in the counterclockwise direction (FIG. 8) and secondly pivoted in the clockwise direction (FIG. 9)

In the illustrations according to FIG. 5 and FIG. 6, the guide-track part 14 is still located within the through-space 13.1 of the blocking device 13, so that the rack 4 cannot be pivoted. When it reaches the fully pulled-out position, that is to say the second operating position, however, the guide-track part 14 can leave the blocking device 13 and be pivoted together with the pull-out rail 9, and therefore with the rack 4, this being brought about by the guide part 16 (driver 16) (FIG. 7), which is able to run in the guide path 15. Following a first section of the pivoting movement, the guide part 16 leaves the guide path 15, as is shown in FIGS. 7, 8 and 9, wherein, depending on whether the rack 4 has been pivoted in the clockwise direction or counterclockwise direction, the two positions illustrated in FIGS. 8 and 9 can be assumed.

Figure 16:
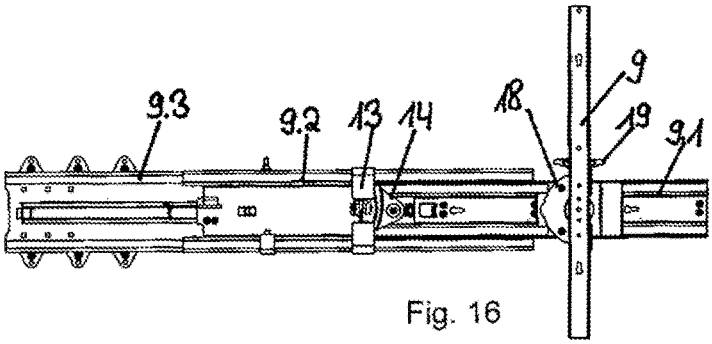
FIG. 16 shows an illustration of the pull-out rails with the rack fully pivoted in the clockwise direction.
Figure 16A:
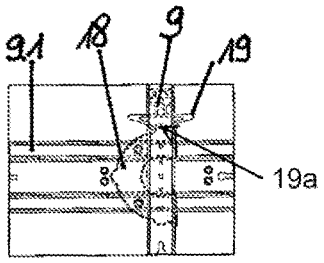
FIG. 16*a* is a schematic detail view of FIG. 16 showing the concavity of the securing device.
Figure 17:
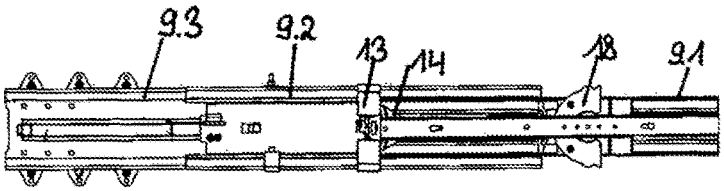
FIG. 17 shows an illustration of the pull-out rails with the rack arranged in the retracted state.
Figure 17A:
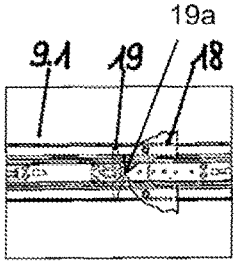
FIG. 17*a* is a schematic detail view of FIG. 17 showing the concavity of the securing device.
Figure 18:
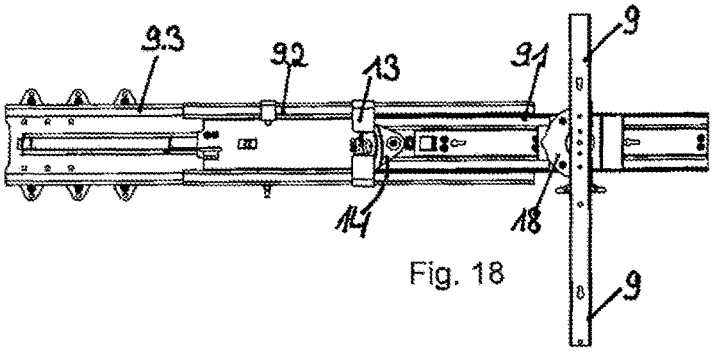
FIG. 18 shows an illustration which is analogous to FIG. 16 and has the rack pivoted in the counterclockwise direction.
Figure 18A:
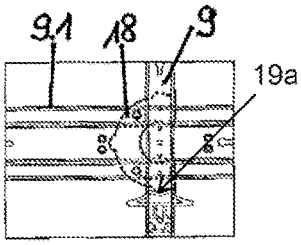
FIG. 18*a* is a schematic detail view of FIG. 18 showing concavity of securing device.

Also provided is an arresting part 18, which interacts with a securing device 19 which is fastened on the first pull-out rail 9.1, as seen in the pull-out direction, and, during the movement from the first operating position into the second operating position, secures the rack 4 with orientation parallel to the pull-out rails 9.1, 9.2, 9.3. For this purpose, the arresting part 18 has three securing formations 18.1, 18.2, 18.3 for the securing device 19 of the rack 4. The securing device 19 has corresponding concavities 19*a* (see FIGS. 16*a*, 17*a*, 18*a*).

What is claimed is:

1. A pull-out apparatus comprising:

a rack comprising a front vertical longitudinal support and a rear vertical longitudinal support and shelves connected to the front and rear vertical longitudinal supports;

the rack further comprising an upper pull-out rail and a lower pull-out rail connected to the front vertical longitudinal support and the rear vertical longitudinal support;

the rack configured to be arranged in a first operating position in an interior space of a cabinet structure such that the rear vertical longitudinal support is arranged rearwardly in the interior space;

the rack configured to have a cabinet door connected to the front vertical longitudinal support;

the rack configured to be moved by a translatory movement from the first operating position into a pull-out position in front of the cabinet structure, wherein the pull-out position is a second operating position, wherein, in the second operating position, the rack is configured to carry out a pivoting movement about a vertical pivot axis;

a blocking device configured to prevent, prior to the second operating position being reached, the rack from carrying out the pivoting movement and configured to release the pivoting movement in the second operating position;

a guide-track part configured to pivot about a vertical axis and comprising a guide path, wherein the guide-track part is operatively connected to the rack so as to move together with the rack into the second operating position;

the rack further comprising a guide part guided in the guide path of the guide-track part during some of the pivoting movement; and during the translatory movement of the rack into the second operating position, the guide-track part being arranged in the blocking device and blocked by the blocking device against pivoting.

2. The pull-out apparatus as claimed in claim 1, wherein the guide path of the guide-track part is curved.

3. The pull-out apparatus as claimed in claim 1, wherein the guide part of the rack is a pin and, during some of the pivoting movement of the rack, engages in the guide path of the guide-track part.

4. The pull-out apparatus as claimed in claim 1, further comprising a telescopic pull-out unit configured to be fastened on the cabinet structure, wherein the telescopic pull-out unit comprises at least three pull-out rails including a first pull-out rail, viewed in a pull-out direction of the rack from the interior space, wherein the lower pull-out rail of the rack is supported in a pivotable manner on the first pull-out rail, and wherein the at least three pull-out rails further include a final pull-out rail, viewed in the pull-out direction of the rack from the interior space, wherein the final pull-out rail is configured to be mounted at a fixed location in the cabinet structure.

5. The pull-out apparatus as claimed in claim 4, wherein the at least three pull-out rails further include a second pull-out rail, arranged behind the first pull-out rail viewed in the pull-out direction of the rack from the interior space, wherein the guide-track part is arranged on the first pull-out rail and the blocking device is arranged on the second pull-out rail, wherein the first pull-out rail is configured to move translatorily relative to the second pull-out rail and the second pull-out rail is configured to move translatorily relative to the final pull-out rail.

6. The pull-out apparatus as claimed in claim 5, wherein the first pull-out rail and the second pull-out rail are forcibly synchronized in respect to a translatory pull-out movement such that, when the second operating position is reached, the guide-track part is transferred into a pull-out-movement position in which the blocking device releases the guide-track part to enable the pivoting movement of the rack.

7. The pull-out apparatus as claimed in claim 4, wherein the rack comprises a securing device configured to interact with an arresting part fastened on the first pull-out rail, wherein, during the movement from the first operating position into the second operating position, the securing device secures the rack in an orientation parallel to the telescopic pull-out unit.

8. The pull-out apparatus as claimed in claim 7, wherein the arresting part comprises a first securing formation configured to arrest the securing device of the rack such that the rack is oriented parallel to the at least three pull-out rails, and further comprises a second securing formation and a third securing formation opposite each other and each configured to arrest the securing device of the rack such that the rack is oriented orthogonally in relation to the at least three pull-out rails.

9. The pull-out apparatus as claimed in claim 4, wherein the at least three pull-out rails include a central pull-out rail arranged between the first pull-out rail and the final pull-out rail, wherein the blocking device comprises two angled limbs fastened at opposite ends of the central pull-out rail and directed toward one another, wherein between the two angled limbs an interspace is formed, wherein the interspace forms a through-space for the rack, wherein the through space is oriented parallel to the at least three pull-out rails, wherein, during the translatory movement of the rack into the second operating position, the two angled limbs form a stop for the guide-track part preventing the guide-track part from pivoting.

10. A piece of furniture comprising a pull-out apparatus as claimed in claim 1.

* * * * *